US009824847B2

(12) United States Patent
Kato

(10) Patent No.: US 9,824,847 B2
(45) Date of Patent: Nov. 21, 2017

(54) X-RAY TUBE

(71) Applicant: Toshiba Electron Tubes & Devices Co., Ltd., Otawara-shi (JP)

(72) Inventor: Takeshi Kato, Nasushiobara (JP)

(73) Assignee: Toshiba Electron Tubes & Devices Co., Ltd., Otawara-shi (JP)

( * ) Notice: Subject to any disclaimer, the term of this patent is extended or adjusted under 35 U.S.C. 154(b) by 49 days.

(21) Appl. No.: 15/068,700

(22) Filed: Mar. 14, 2016

(65) Prior Publication Data

US 2016/0276124 A1 Sep. 22, 2016

(30) Foreign Application Priority Data

Mar. 17, 2015 (JP) ..... 2015-053115

(51) Int. Cl.
*H01J 35/06* (2006.01)
*H01J 35/16* (2006.01)

(52) U.S. Cl.
CPC ..... *H01J 35/06* (2013.01); *H01J 35/165* (2013.01)

(58) Field of Classification Search
CPC ..... H01J 35/06; H01J 35/165
See application file for complete search history.

(56) References Cited

U.S. PATENT DOCUMENTS 2,215,426 A 9/1940 Machlett
5,526,396 A * 6/1996 Jacob ..... H01J 35/06 378/121
6,015,325 A * 1/2000 Inazuru ..... H01J 35/165 228/187
6,044,130 A * 3/2000 Inazura ..... H01J 35/16 378/138
6,801,599 B1 10/2004 Kautz et al.
2005/0058253 A1* 3/2005 Inazuru ..... H01J 35/16 378/143
2006/0093091 A1* 5/2006 Lovoi ..... H01J 35/14 378/119
2007/0211862 A1* 9/2007 Ito ..... H01J 9/26 378/140
2009/0022277 A1* 1/2009 Bard ..... H01J 35/14 378/138
2009/0161830 A1* 6/2009 Inazuru ..... H01J 35/04 378/138

FOREIGN PATENT DOCUMENTS

CN 1501760 A 6/2004
JP 6-96705 4/1994
JP 2000-30642 A 1/2000

OTHER PUBLICATIONS

Office Action dated Jul. 3, 2017, in Chinese Patent Application No. 201610150023.X (with English language translation).

* cited by examiner

*Primary Examiner* — Mark R Gaworecki
(74) *Attorney, Agent, or Firm* — Oblon, McClelland, Maier & Neustadt, L.L.P.

(57) ABSTRACT

According to one embodiment, an X-ray tube includes a cathode, an anode target and an envelope. The cathode includes an insulating member, a conductive line, a pin assembly, a filament, a focusing electrode, and a terminal assembly. The conductive line is formed on the insulating member. The pin assembly includes a pin and a first sleeve. The terminal assembly is fixed to the insulating member, is supporting the filament, and is electrically connecting the filament to the conductive line.

4 Claims, 9 Drawing Sheets

X-RAY TUBE

CROSS-REFERENCE TO RELATED APPLICATIONS

This application is based upon and claims the benefit of priority from Japanese Patent Application No. 2015-053115, filed Mar. 17, 2015, the entire contents of which are incorporated herein by reference.

FIELD

Embodiments described herein relate generally to an X-ray tube.

BACKGROUND

In general, an X-ray tube assembly is used in a medical diagnosis system, an industrial diagnosis system or the like. The X-ray tube assembly comprises an X-ray tube which radiates X-rays, etc. The X-ray tube comprises a cathode including a focusing electrode and a filament which emits electrons, an anode with which the electrons emitted from the filament collide to radiate X-rays, and an envelope which accommodates the cathode and the anode. Electrons traveling from the cathode toward the anode are accelerated by the potential difference between the cathode and the anode, and are focused by the focusing electrode.

The focusing electrode, terminal assemblies and pin assemblies are attached to an insulating member, and electrically insulated from each other by the insulating member. The terminal assemblies support the filament. The pin assemblies are also attached to the envelope. Metallic thin wires (or metallic foil bands) are welded to the terminal assemblies and the pin assemblies, thus electrically connecting the terminal assemblies and the pin assemblies to each other. A current and a voltage are supplied and applied to the filament through the pin assemblies, the metallic thin wires and the terminal assemblies.

DETAILED DESCRIPTION

In general, according to one embodiment, there is provided X-ray tube comprising: a cathode including: an insulating member; a conductive line formed of metal and formed on the insulating member; a pin assembly including a pin having a conductive property and a first sleeve which has a conductive property, is fixed to the insulating member, guides the pin, is fixing the pin, and electrically connects the pin to the conductive line; a filament configured to emit electrons; a focusing electrode configured to focus the electrons emitted from the filament; and a terminal assembly having a conductive property, fixed to the insulating member, supporting the filament, and electrically connecting the filament to the conductive line; an anode target with which the electrons emitted from the cathode collide to generate X-rays; and an envelope which accommodates the insulating member, the conductive line, the first sleeve, the filament, the focusing electrode, the terminal assembly and the anode target, and to which the pin is attached.

Embodiments will be described with reference to the accompanying drawings. The disclosure is a mere example, and arbitrary change of gist which can be easily conceived by a person of ordinary skill in the art naturally falls within the inventive scope as long as the subject matter of the embodiments is maintained. To better clarify the explanations, the drawings may pictorially show width, thickness, shape, etc., of each portion as compared with an actual aspect, but they are mere examples and do not restrict the interpretation of the invention. In the present specification and drawings, after structural elements are each explained once with reference to the drawings, there is a case where their explanations will be omitted as appropriate, and those identical to or similar to the explained structural elements will be denoted by the same reference numbers, respectively, as the explained structural elements.

Embodiment

An X-ray tube according to an embodiment will be explained in detail.

Figure 1:
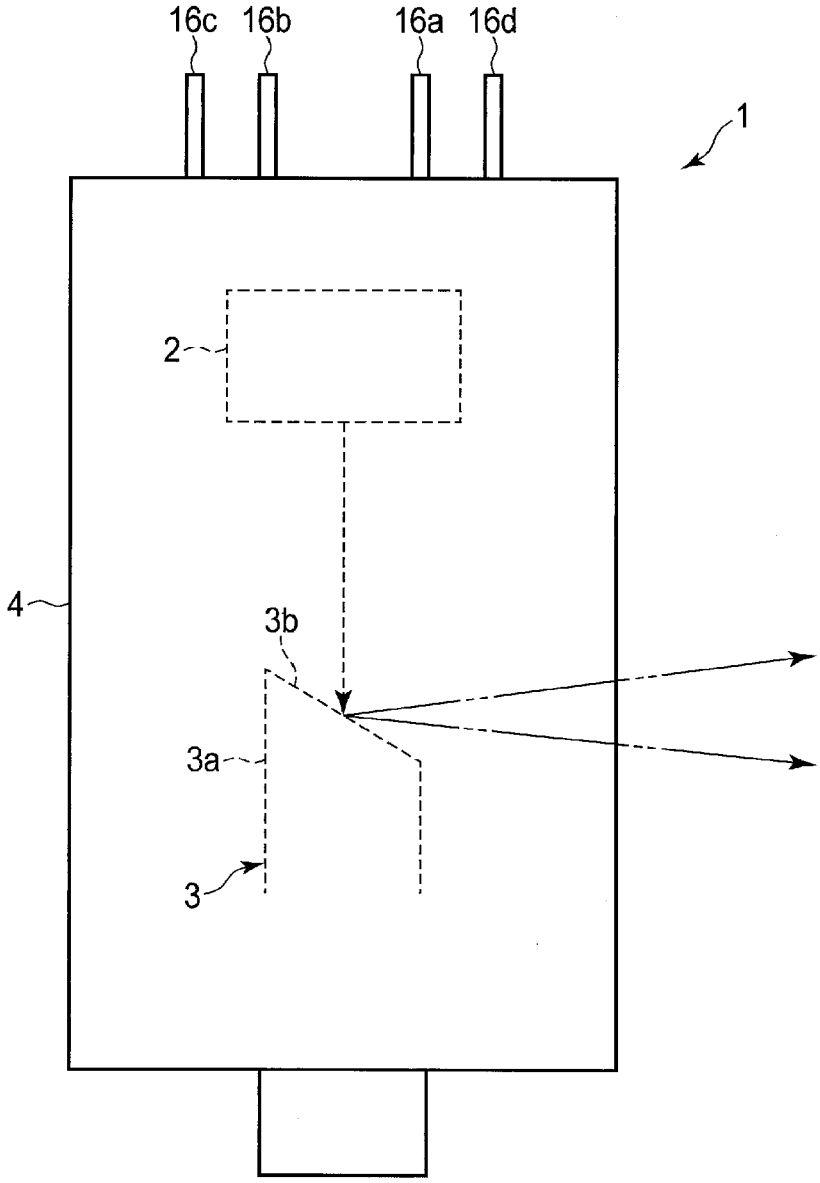
FIG. 1 is a schematic configuration view showing an X-ray tube according to an embodiment.

As shown in FIG. 1, an X-ray tube 1 is a stationary anode X-ray tube. The X-ray tube 1 comprises a cathode 2, an anode target 3 and an envelope 4. The cathode 2 emits electrons (thermal electrons).

The anode target 3 is provided in the envelope 4, and separated from the cathode 2. The relative position of the anode target 3 with respect to the cathode 2 and the envelope 4 is fixed. The anode target 3 comprises a target body 3*a* and a target surface 3*b*. The target surface 3*b* is provided as a surface of the target body 3*a* which faces the cathode 2. When electrons collide with the target surface 3*b*, at the target surface 3*b*, a focal spot is formed from which X-rays are generated. The target body 3*a* and the target surface 3*b* are formed of metal having a high heat resistance. The target body 3*a* can be formed of material having a lower heat resistance than that of the target surface 3*b*. In the embodiment, the target body 3*a* is formed of copper, and the target surface 3*b* is formed of a tungsten alloy.

The envelope 4 is formed of a combination of metal or glass or a combination of metal and glass. The envelope 4 is formed in the shape of a cylinder having end portions which are both closed. The envelope 4 is provided with an X-ray transmission window which transmits X-rays. The envelope 4 is hermetically closed, and is kept evacuated.

The envelope 4 accommodates an insulating plate 11, conductive lines 13, sleeves 17, a filament coil 21, a focusing electrode 23, terminal assemblies 25 and the anode target 3, to be described later. To the envelope 4, cathode pins 16 to be described later are attached.

Figure 2:
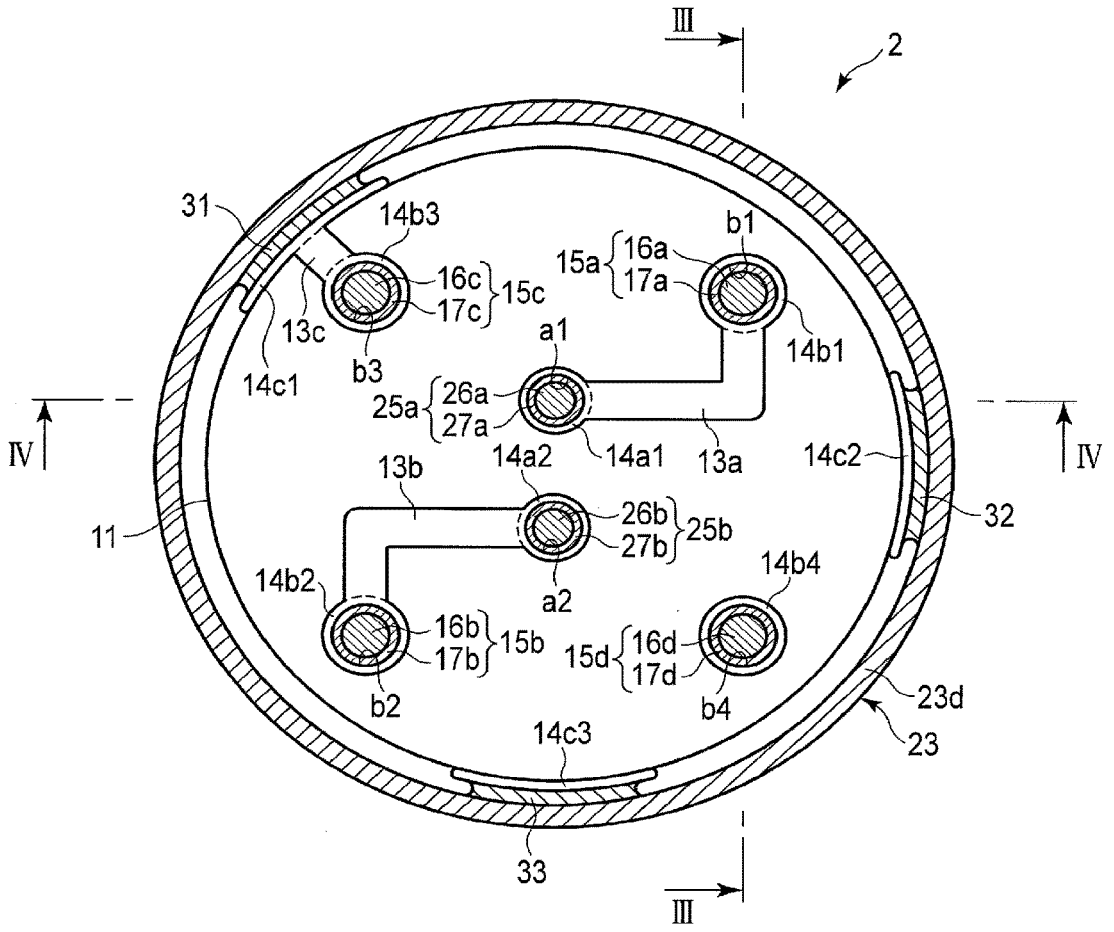
FIG. 2 is a schematic top view showing part of the X-ray tube as shown in FIG. 1, and also showing a cathode.
Figure 3:
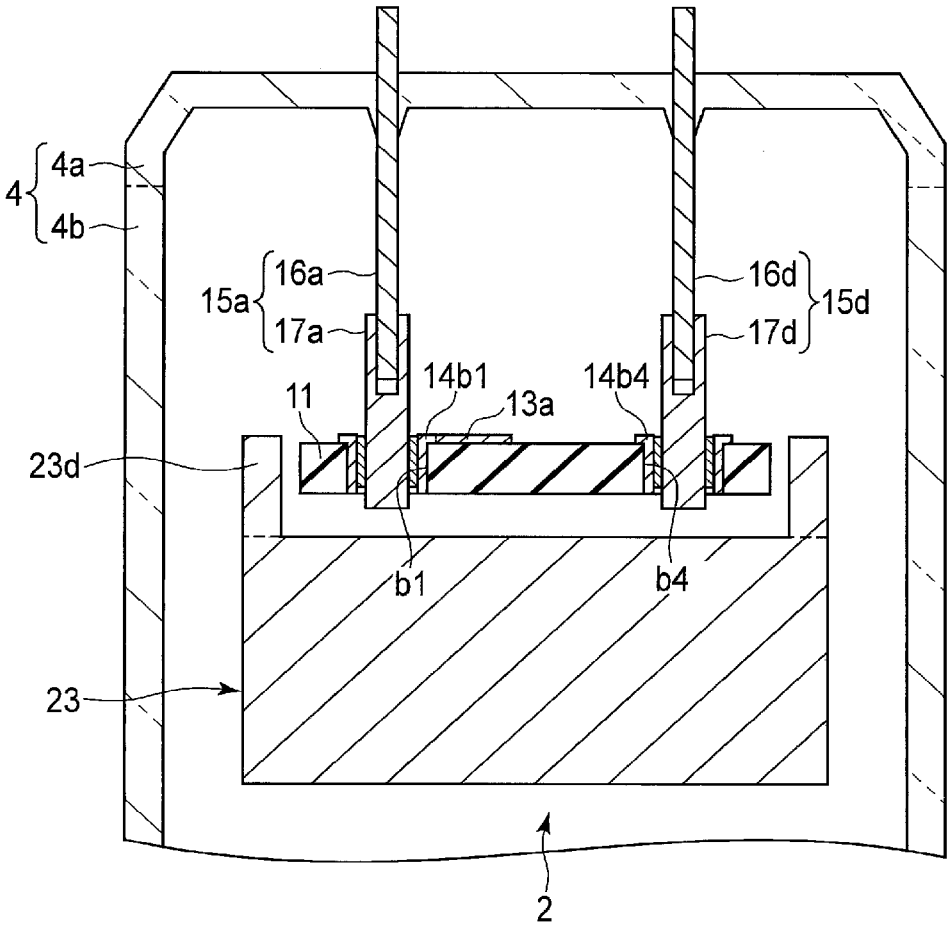
FIG. 3 is a cross-sectional view taken along line III-III in FIG. 2, and showing part of the X-ray tube and also part of an envelope.
Figure 4:
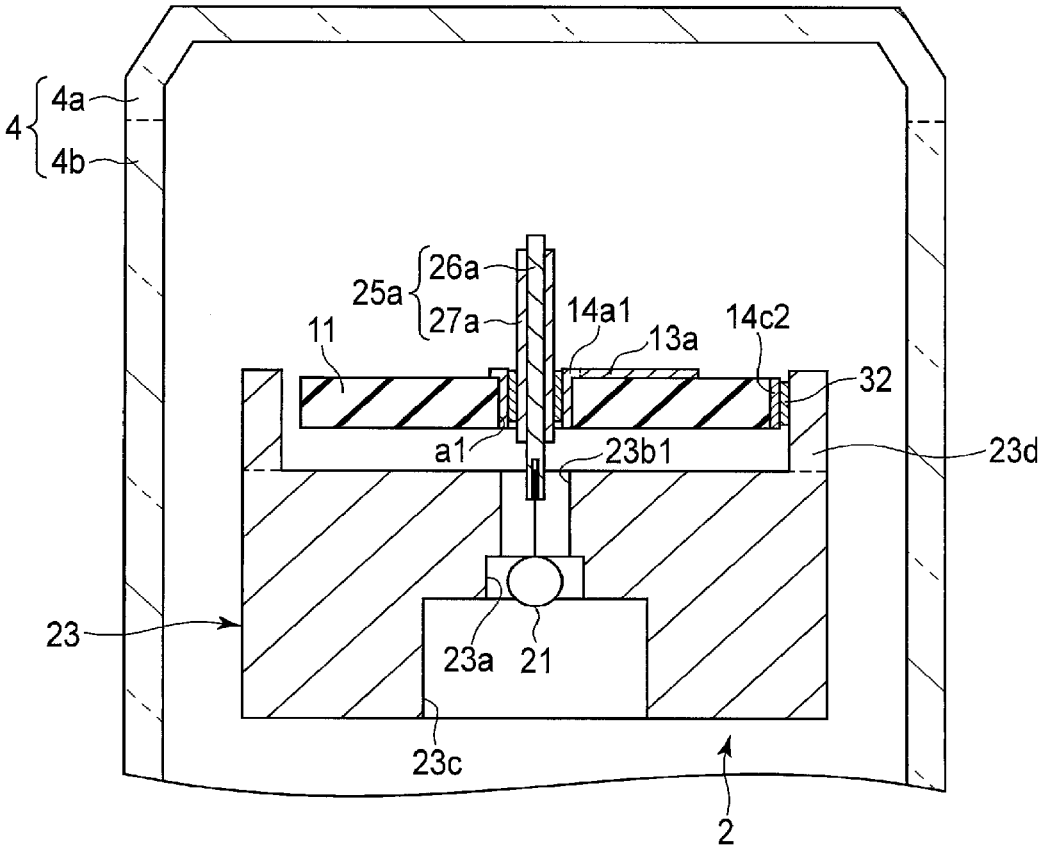
FIG. 4 is a cross-sectional view taken along line IV-IV in FIG. 2, and showing part of the X-ray tube and also part of the envelope.

As shown in FIGS. 2 to 4, the cathode 2 comprises the insulating plate 11, which is provided as an insulating member, the conductive lines 13, conductive layers 14, pin assemblies 15, the filament coil 21, which is provided as a filament, the focusing electrode 23 and the terminal assemblies 25.

The insulating plate 11 is formed of an insulating material, for example, an insulating ceramics, and is also formed discoid. The insulating plate 11 includes through holes formed therein. Those through holes are separated from each other. In the embodiment, in the insulating plate 11, two through holes a1 and a2 are formed for the terminal assemblies 25, and four through holes b1, b2, b3 and b4 are formed for the pin assemblies 15.

The conductive lines 13 and the conductive layers 14 are formed of metal, and provided on the insulating plate 11. As examples of the above metal, nickel (Ni), gold (Au), silver (Ag), aluminum (Al), copper (Cu), molybdenum (Mo), etc., are present. Furthermore, in the embodiment, the conductive lines 13 and the conductive layers 14 are formed of metalized layers which will be described in detail later.

The conductive layers 14 comprise conductive layers 14*a*1, 14*a*2, 14*b*1, 14*b*2, 14*b*3 and 14*b*4 formed in the through holes a1, a2, b1, b2, b3 and b4 and conductive layers 14*c*1, 14*c*2 and 14*c*3 formed on an outer peripheral wall of the insulating plate 11. The conductive layers 14*a*1, 14*a*2, 14*b*1, 14*b*2, 14*b*3 and 14*b*4 continuously extend from inner peripheral walls of the holes to a surface of the insulating plate 11. It should be noted that the above surface of the insulating plate 11 faces a lid portion 4*a* to be described later. The conductive layer 14*c*1 is located close to the conductive layer 14*b*3. The conductive layers 14*c*1, 14*c*2 and 14*c*3 are separated from each other.

The conductive lines 13 comprise conductive lines 13*a*, 13*b* and 13*c*. The conductive line 13*a* is connected to the conductive layers 14*a*1 and 14*b*1. The conductive line 13*b* is connected to the conductive layers 14*a*2 and 14*b*2. The conductive line 13*c* is connected to the conductive layers 14*b*3 and 14*c*1. Referring to FIG. 2, the conductive line 13*a* is formed in a laterally inverted L-shape, the conductive line 13*b* is formed in a vertically inverted L-shape, and the conductive line 13*c* is linearly shaped.

Before attaching the pin assemblies 15 and the terminal assemblies 25 to the insulating plate 11, and also before fixing the focusing electrode 23 to the insulating plate 11, the conductive lines 13 and the conductive layers 14 are formed in advance on the insulating plate 11.

The pin assemblies 15 include cathode pins 16 provided as pins and sleeves 17 provided as first sleeves. The cathode pins 16 have a conductive property. In the embodiment, the cathode pins 16 are formed of metal and also formed in the shape of a rod. The cathode pins 16 are attached to the lid portion 4*a* of the envelope 4. In the embodiment, the lid portion 4*a* and main body 4*b* of the envelope 4 are formed of glass. The cathode pins 16 are fused and vacuum-tightly connected to the lid portion 4*a*, and one end portion of each of the cathode pins 16 is located outside the envelope 4. The sleeves 17 have a conductive property, are fixed to the insulating plate 11, guide the cathode pins 16, and are fixing the cathode pins 16. In the embodiment, the sleeves 17 are formed of metal and in the shape of a rod, and include hole portions for guiding the cathode pins 16.

The lid portion 4*a* is fused and vacuum-tightly connected to the main body 4*b* of the envelope 4. In the embodiment, the lid portion 4*a* is connected to the main body 4*b*, with the cathode pins 16, which are attached to the lid portion 4*a*, inserted in the hole portions of sleeves 17. Then, current is made to flow in the cathode pins 16, thereby resistance-welding the cathode pins 16 to the sleeves 17.

In the embodiment, the pin assemblies 15 comprise four pin assemblies 15*a*, 15*b*, 15*c* and 15*d*.

The pin assembly 15*a* includes a cathode pin 16*a* and a sleeve 17*a*. The sleeve 17*a* electrically connects the cathode pin 16*a* to the conductive line 13*a*. In the embodiment, the sleeve 17*a* is located in a through hole b1, and brazed to the conductive layer 14*b*1. Thereby, the sleeve 17*a* is fixed to the insulating plate 11, and electrically connected to the conductive layer 14*b*1. The cathode pin 16*a* is fixed to and electrically connected to the sleeve 17*a* by resistance welding.

The pin assembly 15*b* includes a cathode pin 16*b* and a sleeve 17*b*. The sleeve 17*b* electrically connects the cathode pin 16*b* to the conductive line 13*b*. In the embodiment, the sleeve 17*b* is located in a through hole b2, and brazed to the conductive layer 14*b*2. Thereby, the sleeve 17*b* is fixed to the insulating plate 11, and electrically connected to the conductive layer 14*b*2. The cathode pin 16*b* is fixed to and electrically connected to the sleeve 17*b* by resistance welding.

The pin assembly 15*c* includes a cathode pin 16*c* and a sleeve 17*c*. The sleeve 17*c* electrically connects the cathode pin 16*c* to the conductive line 13*c*. In the embodiment, the sleeve 17*c* is located in a through hole b3, and brazed to the conductive layer 14*b*3. Thereby, the sleeve 17*c* is fixed to the insulating plate 11, and electrically connected to the conductive layer 14*b*3. The cathode pin 16*c* is fixed to and electrically connected to the sleeve 17*c* by resistance welding.

The pin assembly 15*d* includes a cathode pin 16*d* and a sleeve 17*d*. In the embodiment, the sleeve 17*d* is located in a through hole b4, and brazed to the conductive layer 14*b*4. Thereby, the sleeve 17*d* is fixed to the insulating plate 11, and electrically connected to the conductive layer 14*b*4. The cathode pin 16*d* is fixed to and electrically connected to the sleeve 17*d* by resistance welding.

The filament coil 21 is formed to extend linearly. In the embodiment, the filament coil 21 extends substantially parallel to a line between the through holes a1 and a2. The filament coil 21 is formed of material containing metal, for example, tungsten, as a main ingredient.

The focusing electrode 23 is cylindrically formed, and includes a groove portion 23*a*, hole portions 23*b*1 and 23*b*2, and a groove portion 23*c*. The groove portion 23*a* is open on an anode target side where the anode target 3 is located, and the filament coil 21 is provided in the groove portion 23*a*. The groove portion 23*a* is shaped in the accordance with the shape of the filament coil 21. In the embodiment, the groove portion 23*a* extends in parallel with the filament coil 21. It should be noted that the filament coil 21 is located apart from an inner surface (bottom surface) of the groove portion 23*a*. The hole portions 23*b*1 and 23*b*2 communicate with the groove portion 23*a*. The hole portion 23*b*1 is located opposite to the through hole a1, and the hole portion 23*b*2 is located opposite to the through hole a2. In the hole portions 23*b*1 and 23*b*2, the terminal assemblies 25 and extension portions which are end portions of the filament coil 21 are located. The groove portion 23*c* is open on an anode target side where the anode target 3 is located, and forms an electrical potential distribution to converge electrons emitted from the filament coil 21.

The focusing electrode 23 is fixed to the insulating plate 11. To be more specific, in the embodiment, the focusing electrode 23 is fixed to the insulating plate 11 at three positions by brazing using solder members 31, 32 and 33. The focusing electrode 23 includes an annular portion 23*d* which surrounds the outer peripheral wall of the insulating plate 11. The solder member 31 is located between the annular portion 23*d* and the conductive layers 14*c*1, and soldered to the annular portion 23*d* and the conductive layers 14*c*1. The solder member 32 is located between the annular portion 23*d* and the conductive layers 14*c*2, and soldered to the annular portion 23*d* and the conductive layers 14*c*2. The solder member 33 is located between the annular portion 23*d* and the conductive layers 14*c*3, and soldered to the annular portion 23*d* and the conductive layers 14*c*3.

Also, the focusing electrode 23 is electrically connected to the cathode pin 16*c*. To be more specific, in the embodiment, the focusing electrode 23 is electrically connected to the cathode pin 16*c*, with the following elements interposed between them: the solder member 31; the conductive layers 14*c*1; the conductive line 13*c*; the conductive layer 14*b*3; a solder member (a solder member soldered to the conductive layer 14*b*3 and the sleeve 17*c*); and the sleeve 17*c*.

The terminal assemblies 25 have a conductive property, and is fixed to the insulating plate 11 to support the filament coil 21. The terminal assemblies 25 electrically connect the filament coil 21 to the conductive lines 13*a* and 13*b*.

The terminal assemblies 25 include filament terminals 26 provided as terminals and sleeves 27 provided as second sleeves. The filament terminals 26 have a conductive property. In the embodiment, the filament terminals 26 are formed of metal and also formed in the shape of a rod. The filament terminals 26 support the extension portions of the filament coil 21, and are electrically connected to the extension portion. It should be noted that the filament coil 21 is fixed to the filament terminals 26 by welding such as laser beam welding. The sleeves 27 have a conductive property, are fixed to the insulating plate 11, guides the filament terminals 26, and are fixing the filament terminals 26. The sleeves 27 electrically connect the filament terminals 26 to the conductive lines 13*a* and 13*b*. In the embodiment, the sleeves 27 are formed of metal and cylindrically formed, and include hole portions for guiding the filament terminals 26.

In the embodiment, the terminal assemblies 25 comprise two terminal assemblies 25*a* and 25*b*.

The terminal assembly 25*a* includes a filament terminal 26*a* and a sleeve 27*a*. The sleeve 27*a* electrically connects the filament terminal 26*a* to the conductive line 13*a*. In the embodiment, the sleeve 27*a* is located in the through hole a1, and brazed to the conductive layer 14*a*1. Thereby, the sleeve 27*a* is fixed to the insulating plate 11, and electrically connected to the conductive layer 14*a*1. The filament terminal 26*a* supports one of the extension portions of the filament coil 21. Also, the filament terminal 26*a* is fixed to and electrically connected to the sleeve 27*a* by resistance welding.

The terminal assembly 25*b* includes a filament terminal 26*b* and a sleeve 27*b*. The sleeve 27*b* electrically connects the filament terminal 26*b* to the conductive line 13*b*. In the embodiment, the sleeve 27*b* is located in the through hole a2, and brazed to the conductive layer 14*a*2. Thereby, the sleeve 27*b* is fixed to the insulating plate 11, and electrically connected to the conductive layer 14*a*2. The filament terminal 26*b* supports the other extension portion of the filament coil 21. The filament terminal 26*b* is fixed to and electrically connected to the sleeve 27*b* by resistance welding.

It should be noted that fixing (resistance welding) of the filament terminal 26*a* to the sleeve 27*a* and that of the filament terminal 26*b* to the sleeve 27*b* are achieved by making current flow in the filament terminals 26*a* and 26*b* after the filament coil 21 is positioned with respect to the groove portion 23*a* of the focusing electrode 23.

A voltage and current from a power supply unit located outside the X-ray tube 1 are applied and supplied to the cathode pins 16*a* and 16*b*, and then to the filament coil 21. Thereby, the filament coil 21 emits electrons (thermal electrons). The above power supply unit also applies a predetermined voltage to the anode target 3. Since an X-ray tube voltage (tube voltage) is applied between the anode target 3 and the cathode 2, electrons emitted from the filament coil 21 are accelerated and incident upon the target surface 3*b* as an electron beam. That is, an X-ray tube current (tube current) flows from the cathode 2 to a focal spot on the target surface 3*b*.

Furthermore, the power supply unit applies a voltage to the cathode pin 16*c*, as a result of which the voltage is applied to the focusing electrode 23. Thereby, the focusing electrode 23 can focus an electron beam (electrons) which will travel from the filament coil 21 toward the anode target 3 through opening of the groove portion 23*c*.

X-rays are radiated from the target surface 3*b* upon incidence of the electron beam on the target surface 3*b*. To be more specific, X-rays radiated from the focal spot on the target surface 3*b* are radiated to the outside of the X-ray tube 1 after transmitted through the envelope 4.

The X-ray tube 1 according to the embodiment having the above structure comprises the cathode 2, the anode target 3 and the envelope 4. The cathode 2 comprises the insulating plate 11, the conductive lines 13, the pin assemblies 15, the filament coil 21, the focusing electrode 23 and the terminal assemblies 25. The conductive lines 13 are formed of metal and provided on the insulating plate 11. The conductive lines 13 form part of a circuit of the cathode 2.

The pin assemblies 15 include the cathode pins 16, which are conductive, and the sleeves 17. The sleeves 17 are conductive, are fixed to the insulating plate 11, guide the cathode pin 16, are fixing the cathode pin 16, and are electrically connect the cathode pins 16 to the conductive lines 13. The sleeve 17*a* electrically connects the cathode pin 16*a* to the conductive line 13*a*. The sleeve 17*b* electrically connects the cathode pin 16*b* to the conductive line 13*b*. The sleeve 17*c* electrically connects the cathode pin 16*c* to the conductive line 13*c*.

The terminal assemblies 25 are conductive, are fixed to the insulating plate 11, support the filament coil 21, and electrically connect the filament coil 21 to the conductive lines. The terminal assembly 25*a* electrically connects the filament coil 21 to the conductive line 13*a*; and the terminal assembly 25*b* electrically connects the filament coil 21 to the conductive line 13*b*.

The pin assembly 15*a* and the terminal assembly 25*a* are connected by the conductive line 13*a*, which is formed on the insulating plate 11. The pin assembly 15*b* and the terminal assembly 25*b* are connected by the conductive line 13*b*, which is formed on the insulating plate 11. Thus, it is not necessary to use metallic thin wire (or metallic foil band) to connect the pin assembly 15*a* and the terminal assembly 25*a*. Also, it is not necessary to use metallic thin wire (or metallic foil band) to connect the pin assembly 15*b* and the terminal assembly 25*b*. Accordingly, it is possible to save a labor for connecting the pin assemblies 15 and the terminal assemblies 25, which is required in the case where the pin assemblies 15 and the terminal assemblies 25 are connected by metallic thin wires (or metallic foil bands). Therefore, the cathode 2 can be very simply assembled. Furthermore, it is possible to prevent generation of a foreign matter, which would generate in the case where metallic thin wires (or metallic foil bands) are resistance-welded to the pin assemblies 15 and the terminal assemblies 25.

In addition, since it is not necessary to weld metallic thin wires (or metallic foil bands) to the pin assemblies 15 and the terminal assemblies 25, it is possible to prevent current and heat necessary for welding from being added to the terminal assemblies 25 (the filament terminals 26). It is therefore also possible to restrict occurrence of problems such as deformation of the filament coil 21, displacement of the filament coil 21, and contact of the focusing electrode 23 with the filament coil 21.

By virtue of the above structural features, it is possible to obtain an X-ray tube 1 which can be more simply manufactured. Alternatively, it is possible to obtain X-ray tube 1 whose manufacturing yield is high.

(First Modification)

A first modification of the X-ray tube 1 according to the above embodiment will be explained.

Figure 5:
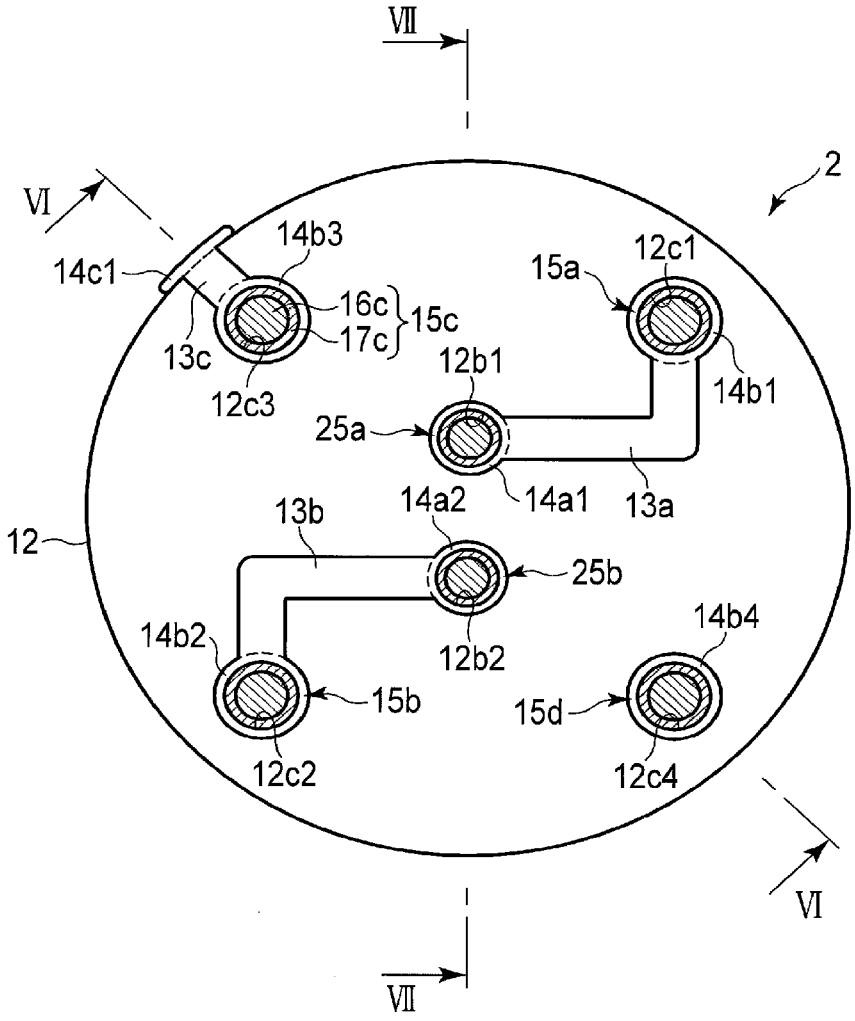
FIG. 5 is a schematic view showing part of a first modification of the above X-ray tube and also showing a cathode.
Figure 6:
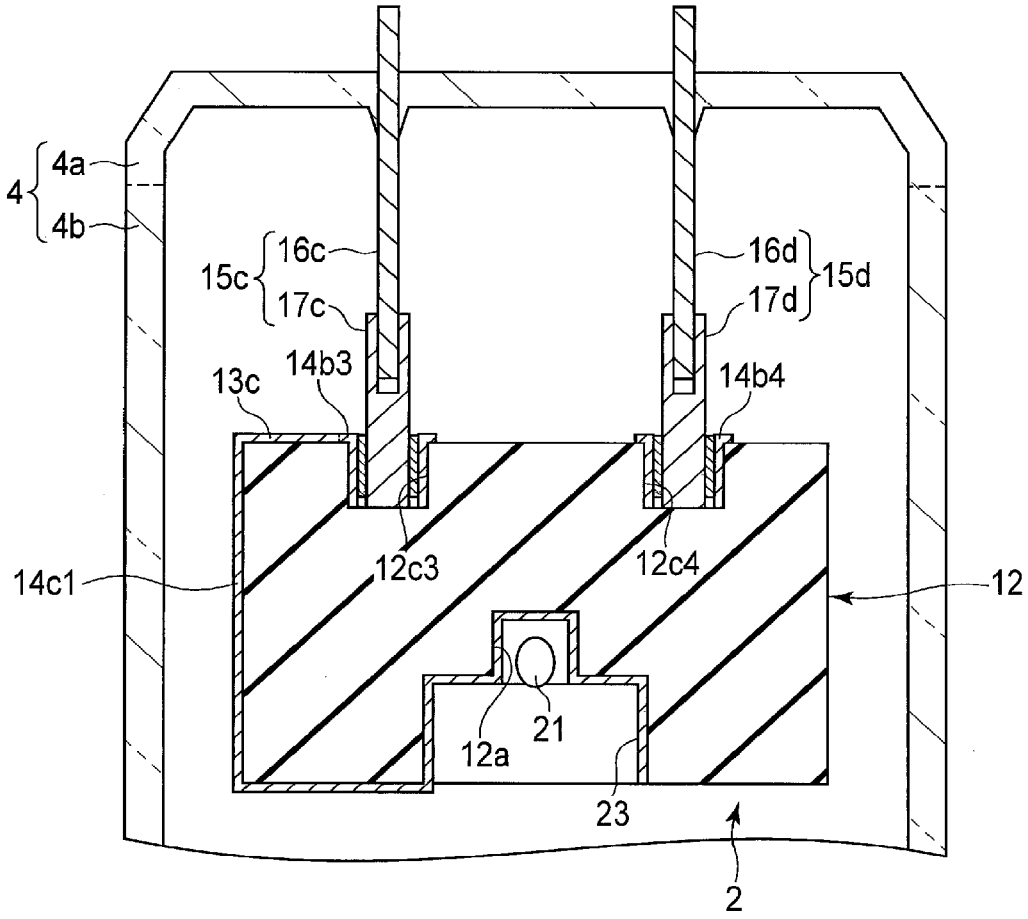
FIG. 6 is a cross-sectional view taken along line VI-VI in FIG. 5, and showing part of the X-ray tube and also part of an envelope.
Figure 7:
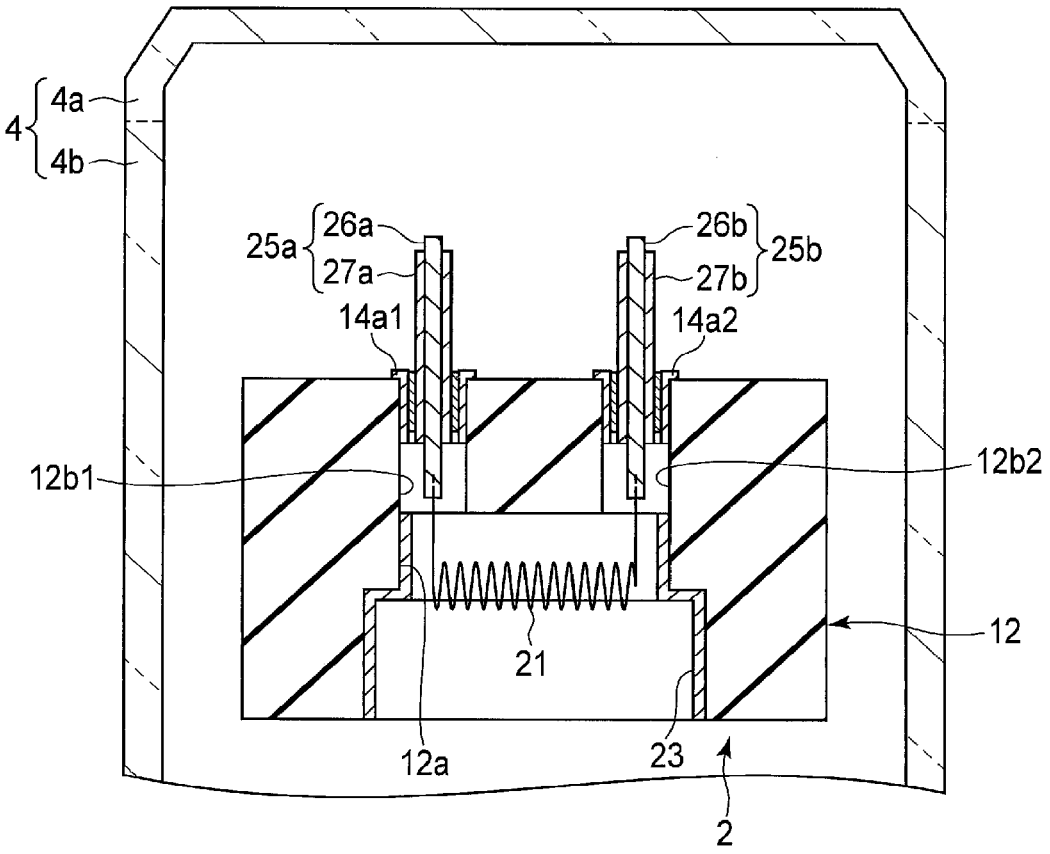
FIG. 7 is a cross-sectional view taken along line VII-VII in FIG. 5, and showing part of the X-ray tube and also part of the envelope.

As shown in FIGS. 5 to 7, roughly speaking, the first modification is different from the above embodiment on the following points: in the first modification, a cathode 2 includes an insulating member 12 instead of the insulating plate 11, and a focusing electrode 23 has a different shape from that of the focusing electrode 23 of the embodiment.

The insulating member 12 is formed of an insulating material, for example, insulating ceramic; and is formed cylindrically. In the insulating member 12, a groove portion 12*a*, hole portions 12*b* and opening portions 12*c* are formed. The hole portions 12*b* and the opening portions 12*c* are separated from each other. The groove portion 12*a* is open on an anode target side where an anode target 3 is located. The groove portion 12*a* is shaped in accordance with the shape of a filament coil 21. In the first modification, the groove portion 12*a* extends in parallel with the filament coil 21. It should be noted that the filament coil 21 is located apart from an inner surface (bottom surface) of the groove portion 12*a*. In the groove portion 12*a*, the filament coil 21 is provided.

To be more specific, in the first modification, the insulating member 12 includes two hole portions 12*b*1 and 12*b*2 for terminal assemblies 25 and four opening portions 12*c*1, 12*c*2, 12*c*3 and 12*c*4 for pin assemblies 15. The hole portions 12*b*1 and 12*b*2 communicate with the groove portion 12*a*. In the hole portions 12*b*1 and 12*b*2, the terminal assemblies 25 and extension portions which are end portions of the filament coil 21 are located.

Conductive lines 13 and conductive layers 14 are formed of metal and located on the insulating member 12. The conductive layers 14 include conductive layers 14*a*1, 14*a*2, 14*b*1, 14*b*2, 14*b*3 and 14*b*4 which are formed in the hole portions 12*b*1 and 12*b*2 and the opening portions 12*c*1, 12*c*2, 12*c*3 and 12*c*4, and a conductive layer 14*c*1 formed on an outer peripheral wall of the insulating member 12. The conductive layers 14*a*1, 14*a*2, 14*b*1, 14*b*2, 14*b*3 and 14*b*4 continuously extend from inner peripheral walls of the opening portions and hole portions to a surface of the insulating member 12. It should be noted that the above surface of the insulating member 12 faces the lid portion 4*a*. The conductive layer 14*c*1 is located close to the conductive layer 14*b*3. The conductive lines 13 include conductive lines 13*a*, 13*b* and 13*c*. The conductive layer 14*c*1 electrically connects the conductive line 13*c* to the focusing electrode 23. Before the pin assemblies 15 and the terminal assemblies 25 are attached to the insulating member 12, the conductive lines 13 and the conductive layers 14 are formed on the insulating member 12 in advance. The focusing electrode 23 is formed in the shape of a film. The focusing electrode 23 is formed in the groove portion 12*a*. In the first modification, the focusing electrode 23 is continuously formed from an inner peripheral wall of the groove portion 12*a* to a bottom wall thereof. Also, the focusing electrode 23 is formed of, for example, a metalized layer which will be described in detail later.

Sleeves 17 of the pin assemblies 15 are provided in the opening portions 12*c*, and brazed to the conductive layers 14*b*. Thereby, the sleeves 17 are fixed to the insulating member 12, and electrically connected to the conductive layers 14*b*.

Sleeves 27 of the terminal assemblies 25 are provided in the hole portions 12*b*, and brazed to the conductive layers 14*a*. Thereby, the sleeves 27 are fixed to the insulating member 12, and electrically connected to the conductive layers 14*a*.

It should be noted that fixing (resistance welding) of filament terminals 26 to the sleeves 27 is carried out by making current flow in the filament terminals 26, after the filament coil 21 is positioned with respect to the focusing electrode 23.

The X-ray tube 1 according to the first modification having the above structure also has the same advantage as the X-ray tube 1 according to the above embodiment.

(Second Modification)

A second modification of the X-ray tube 1 according to the above embodiment will be explained.

Figure 8:
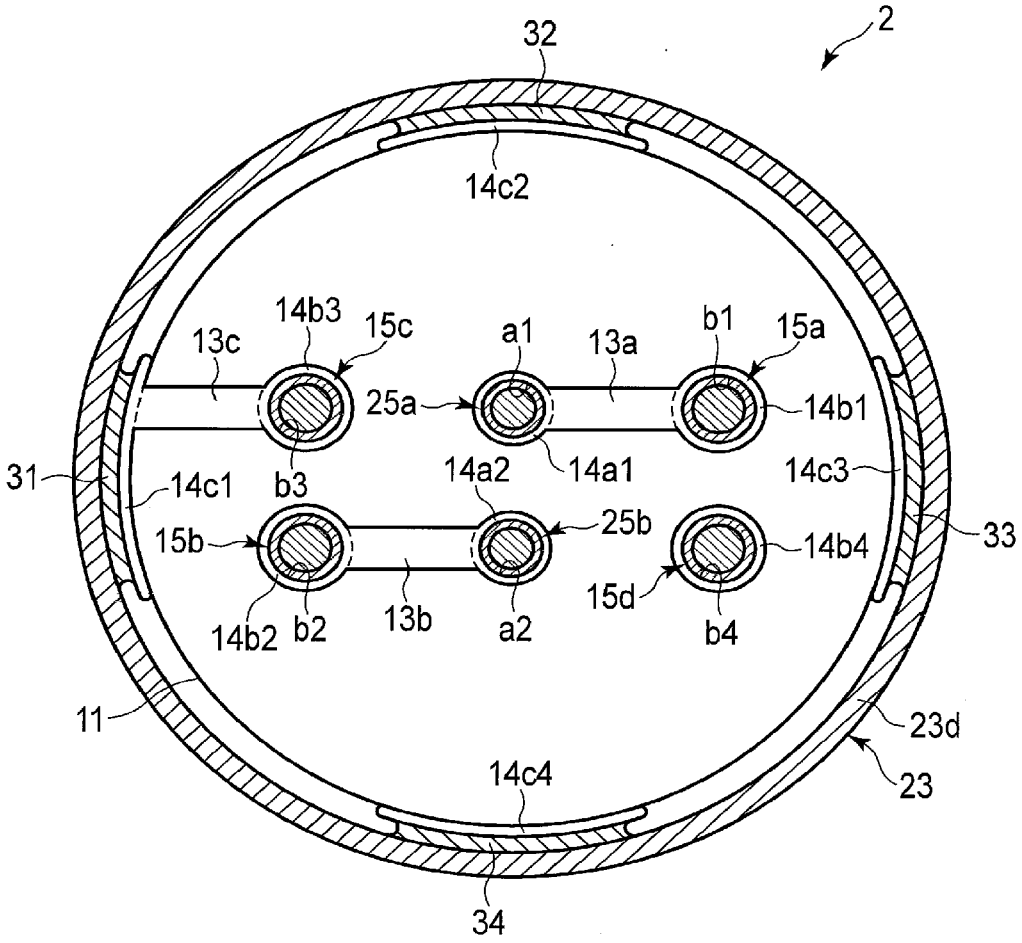
FIG. 8 is a schematic view showing part of a second modification of the above X-ray tube and also showing a cathode.

As shown in FIG. 8, roughly speaking, the second modification is different from the above embodiment with respect to the positions of the through holes b1, b2, b3 and b4 and the shapes of the conductive lines 13*a*, 13*b* and 13*c*.

Through holes a1, b1 and b3 are located on the same line. Also, through holes a2, b2 and b4 are located on the same line. The conductive lines 13*a*, 13*b* and 13*c* are linearly formed.

Conductive layers 14 include conductive layers 14*a*1, 14*a*2, 14*b*1, 14*b*2, 14*b*3, 14*b*4, 14*c*1, 14*c*2 and 14*c*3, and further include a conductive layer 14*c*4 formed on an outer peripheral wall of an insulating plate 11. The conductive layers 14*c*1, 14*c*2, 14*c*3 and 14*c*4 are separated from each other.

A focusing electrode 23 is fixed to the insulating plate 11 at four positions by brazing using solder member 31, 32, 33 and 34. For example, the solder member 34 is located between an annular portion 23*d* and the conductive layer 14*c*4, and soldered to the annular portion 23*d* and the conductive layer 14*c*4.

Before attaching pin assemblies 15 and terminal assemblies 25 to an insulating plate 11, and also before fixing a focusing electrode 23 to the insulating plate 11, the conductive lines 13 and conductive layers 14 are formed in advance on the insulating plate 11.

The X-ray tube 1 according to the second modification having the above structure also has the same advantage as the X-ray tube 1 according to the above embodiment.

(Third Modification)

A third modification of the X-ray tube 1 according to the above embodiment will be explained.

Figure 9:
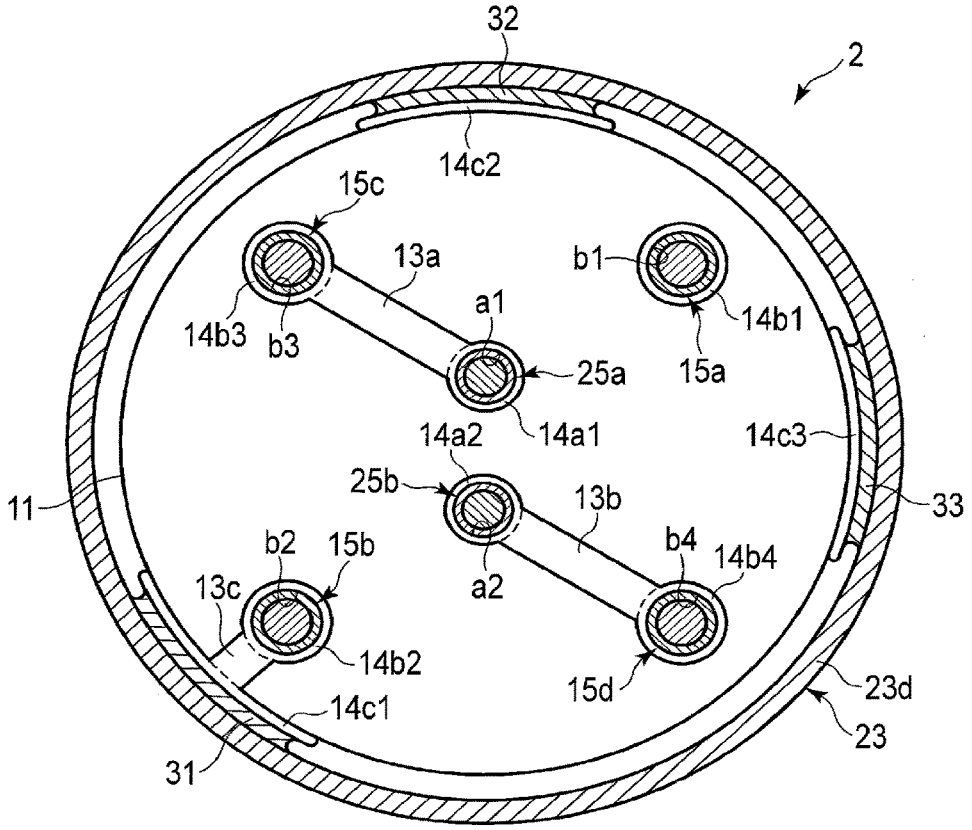
FIG. 9 is a schematic view showing part of a third modification of the above X-ray tube and also showing a cathode.

As shown in FIG. 9, roughly speaking, the third modification is different from the above embodiment with respect to the connections and shapes of the conductive lines 13, the positions of the conductive layers 14*c*1, 14*c*2 and 14*c*3, and the positions of the solder members 31, 32 and 33.

The conductive layer 14*c*1 is located close to a conductive layer 14*b*2. The conductive layers 14*c*1, 14*c*2 and 14*c*3 are separated from each other.

A conductive line 13*a* is connected to conductive layers 14*a*1 and 14*b*3. A conductive line 13*b* is connected to conductive layers 14*a*2 and 14*b*4. A conductive line 13*c* is connected to conductive layers 14*b*2 and 14*c*1. The conductive lines 13*a*, 13*b* and 13*c* are linearly formed.

Before attaching pin assemblies 15 and terminal assemblies 25 to an insulating plate 11, and also before fixing a focusing electrode 23 to the insulating plate 11, the conductive lines 13 and conductive layers 14 are formed in advance on the insulating plate 11.

The X-ray tube 1 according to the third modification having the above structure also has the same advantage as the X-ray tube 1 according to the above embodiment.

(Fourth Modification)

A fourth modification of the X-ray tube 1 according to the above embodiment will be explained.

Figure 10:
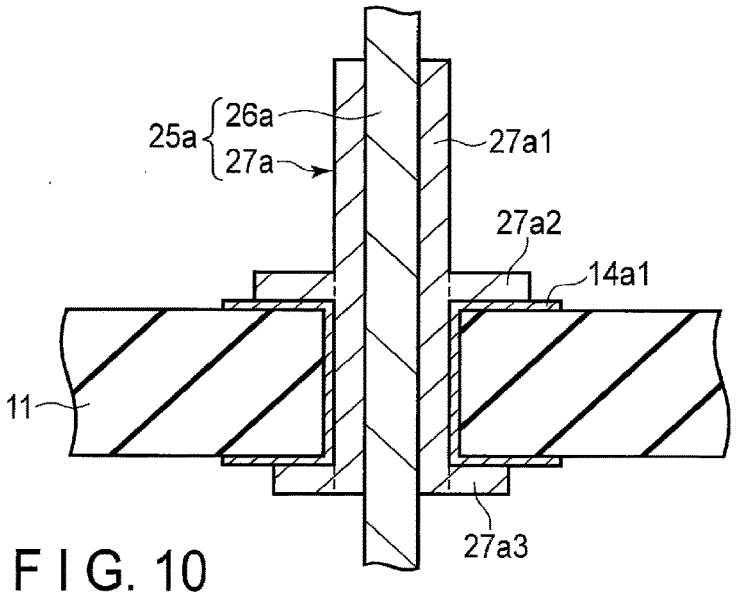
FIG. 10 is a cross-sectional view showing part of a fourth modification of the X-ray tube, and also showing that a sleeve of a terminal assembly is crimped in an insulating plate.

As shown in FIG. 10, roughly speaking, the fourth modification is different from the above embodiment with respect to the method of fixing the sleeves 27 to the insulating plate 11. The sleeves 27 are crimped in the insulating plate 11.

To be more specific, for example, a sleeve 27*a* of a terminal assembly 25*a* includes a tubular portion 27*a*1, a collar portion 27*a*2 and a stop portion 27*a*3. The collar portion 27*a*2 is formed in the shape of a ring, and fixed to an outer peripheral surface of the tubular portion 27*a*1. In the fourth modification, the tubular portion 27*a*1 and the collar portion 27*a*2 are formed integral with each other. The stop portion 27*a*3 is formed in the shape of a ring, and fixed to a distal end portion of the tubular portion 27*a*1. In the fourth modification, the tubular portion 27*a*1 and the stop portion 27*a*3 are formed integral with each other. The stop portion 27*a*3 is plastically deformed. The collar portion 27*a*2 and the stop portion 27*a*3 are pressure-welded to a conductive layer 14*a*1. Thus, the sleeve 27*a* is fixed to the insulating plate 11, and electrically connected to the conductive layer 14*a*1.

The X-ray tube 1 according to the fourth modification having the above structure also has the same advantage as the X-ray tube 1 according to the above embodiment.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

For example, the conductive lines 13 may be formed as the same material as the conductive layers 14 or may be formed of a different material from that of the conductive layers 14. In any case, it suffices that the conductive lines 13 and the conductive layers 14 are formed of material having a conductive property.

The conductive lines 13 may be formed of well-known metalized layers.

Metalized layers are formed on a base-plate of ceramics as following steps.

First, the base-plate is coated or printed with the paste including a refractory metal, like molybdenum, as a main component.

Then, coated or printed base-plate is fired in furnace.

In general, when a metal part is brazed to a ceramic part, metalized layers are formed on the ceramic part as an interposing member.

Alternatively, the conductive lines 13 may be formed as follows:

The conductive lines 13 may be formed of metalized layers and solder members formed on the metalized layers;

The conductive lines 13 may be formed of metalized layers, metal foils and solder members which solder the metal foils to the metalized layers;

The conductive lines 13 may be formed of metalized layers and metallic layers which are formed on the metalized layers by evaporation; and The conductive lines 13 may be formed by a well-known technique other than the above techniques.

The sleeves 17 of the pin assemblies 15 may be crimped in the insulating plate 11.

The filament terminals 26 may be fixed to and electrically connected to the sleeves 27 by tungsten inert gas (TIG) soldering.

The focusing electrode 23 may be fixed to the insulating plate 11 by thread-fastening. In this case, a through hole which allows a screw to be passed therethough is formed in the focusing electrode 23, and a screw hole is formed in the insulating plate 11.

Alternatively, the focusing electrode 23 may be crimped in the insulating plate 11.

The filament of the embodiment is not limited to the filament coil 21; that is, as the filament, various kinds of filaments such as a plate filament can be applied. It should be noted that the plate filament is a filament formed in the shape of a plate including a flat electron radiation surface.

The above embodiment is not limited to the above stationary anode X-ray tube, and can be applied to various kinds of stationary anode X-ray tubes and rotation anode X-ray tubes.

What is claimed is:

1. An X-ray tube comprising:

a cathode including: an insulating member; a conductive line formed of metal and formed on the insulating member; a pin assembly including a pin having a conductive property and a first sleeve which has a conductive property, is fixed to the insulating member, guides the pin, is fixing the pin, and electrically connects the pin to the conductive line; a filament configured to emit electrons; a focusing electrode configured to focus the electrons emitted from the filament; and a terminal assembly having a conductive property, fixed to the insulating member, supporting the filament, and electrically connecting the filament to the conductive line;

an anode target with which the electrons emitted from the cathode collide to generate X-rays; and an envelope which accommodates the insulating member, the conductive line, the first sleeve, the filament, the focusing electrode, the terminal assembly and the anode target, and to which the pin is attached.

2. The X-ray tube of claim 1, wherein the terminal assembly includes: a terminal having a conductive property and supporting the filament; and a second sleeve which has a conductive property, is fixed to the insulating member, guides the terminal, is fixing the terminal, and electrically connects the terminal to the conductive line.

3. The X-ray tube of claim 1, wherein the insulating member includes a groove portion in which the filament is provided, and a hole portion which communicates with the groove portion and in which the terminal assembly is located, and the focusing electrode is formed in the groove portion.

4. The X-ray tube of claim 1, wherein the pin is connected to the first sleeve by welding.

* * * * *